United States Patent [19]

Ackermann

[11] Patent Number: 5,052,318

[45] Date of Patent: Oct. 1, 1991

[54] ADJUSTABLE STITCH CHAIN CUTTING ASSEMBLY INLET

[75] Inventor: Manfred Ackermann, Elmhurst, Ill.

[73] Assignee: Union Special Corporation, Chicago, Ill.

[21] Appl. No.: 542,844

[22] Filed: Jun. 22, 1990

[51] Int. Cl.[5] ..... D05B 65/06

[52] U.S. Cl. ..... 112/288; 112/287

[58] Field of Search ..... 112/287, 288, DIG. 1

[56] References Cited

U.S. PATENT DOCUMENTS 2,989,935 6/1961 Butler ..... 112/287

3,143,987 8/1964 Daniel et al. ..... 112/287

*Primary Examiner*—Werner H. Schroeder

*Assistant Examiner*—Sullivan C. Prak

*Attorney, Agent, or Firm*—Morgan & Finnegan

[57] ABSTRACT

An adjustable inlet including two members which act together to define an opening through which the stitch chain enters a stitch chain cutting assembly to be cut. Each member contains a top and a front side substantially perpendicular to each other. The members are adjustably mounted at the entrace to the stitch chain cutting assembly by a combination of a screw and a pin, which fit through holes located in the front side of each member. The holes are elongated to allow adjustment of one or both members upon loosening of the screw, which adjustment would result in the narrowing or enlargining of the inlet.

5 Claims, 4 Drawing Sheets

ADJUSTABLE STITCH CHAIN CUTTING ASSEMBLY INLET

BACKGROUND OF THE INVENTION

This invention relates to an improvement in sewing machines and more particularly to an adjustable inlet to a stitch chain cutting assembly of a sewing machine.

Stitch chain cutting assemblies have been used extensively in industrial sewing machines, such as overedge or flatbed machines, to sever the leading or trailing end of a stitch chain. Suction draws the stitch chain into the cutting assembly through the inlet, where it is severed by cutting blades and carried away. The cutting blades are driven by either mechanical or pneumatic means.

Illustrative of mechanically driven stitch chain cutting assemblies are U.S. Pat. No. 4,332,209 to Gauch and U.S. Pat. No. 4,523,535 to Blackburn. Illustrative of pneumatically driven stitch chain cutting assemblies is U.S. Pat. No. 4,091,756 to von Hagen. Pneumatically driven stitch chain cutting assemblies are also commercially made by Union Special Corporation, Chicago, IL., under the tradename "AIR-KLIPP" chain cutters. Union Special Corporation machines utilizing the "AIR-KLIPP" chain cutting assembly include styles HF611K112MF, HF611K112MG and HF611K151MF.

Conventional practice in the field of overedge and flatbed sewing machines suffers the disadvantage that the inlet to the stitch chain cutting assembly of such machines is non-adjustable and is, therefore, not readily adaptable to accept stitch chains of various thicknesses. For example, on the machines manufactured by Union Special Corporation named above, when it is desired to alter the thickness of a stitch chain, it is necessary to remove the member defining the inlet and replace it with an inlet of a size appropriate to the desired stitch chain thickness. Therefore, one machine requires several different interchangeable inlets to accommodate the different stitch chain thicknesses employed.

It is, therefore, an object of the present invention to provide an improved inlet to stitch chain cutting assemblies for overedge and flatbed sewing machines.

Another object of the present invention is to provide a stitch chain cutting assembly inlet which is able to accommodate stitch chains of various thicknesses.

SUMMARY OF THE INVENTION

These and other objects of the present invention are met in accordance with this invention by providing an adjustable inlet comprised of two members which act together to define an opening through which the stitch chain enters a stitch chain cutting assembly to be cut. Each member contains a top and a front side substantially perpendicular to each other. The members are adjustably mounted at the entrance to the stitch chain cutting assembly by the combination of a screw and a pin, which fit through elongated holes located in the front side of each member. One or both of the first and second members may be adjusted to the extent allowed by the elongated holes upon loosening of the screw. Adjustment of one or both members results in the narrowing or enlarging of the inlet.

DETAILED DESCRIPTION OF PREFERRED EMBODIMENT

The adjustable stitch chain cutting assembly inlet of the present invention is disclosed in association with an overedge or flatbed sewing machine of the type manufactured and sold by Union Special Corporation and utilizing the "AIR-KLIPP" stitch chain cutting assembly. Both overedge and flatbed sewing machines are well known in the art, and therefore, only those portions of the machine which are necessary to an understanding of the present invention are illustrated. The details of an overedge sewing machine are illustrated and described in U.S. Pat. No. 2,704,042 to Wallenberg et al. Typical of patents relating to flatbed sewing machines are U.S. Pat. No. 2,729,179 to Attwood and U.S. Pat. No. 2,780,192 to Attwood. However, it is to be understood that the present invention may also be applied to various other types of sewing machines.

Figure 1:
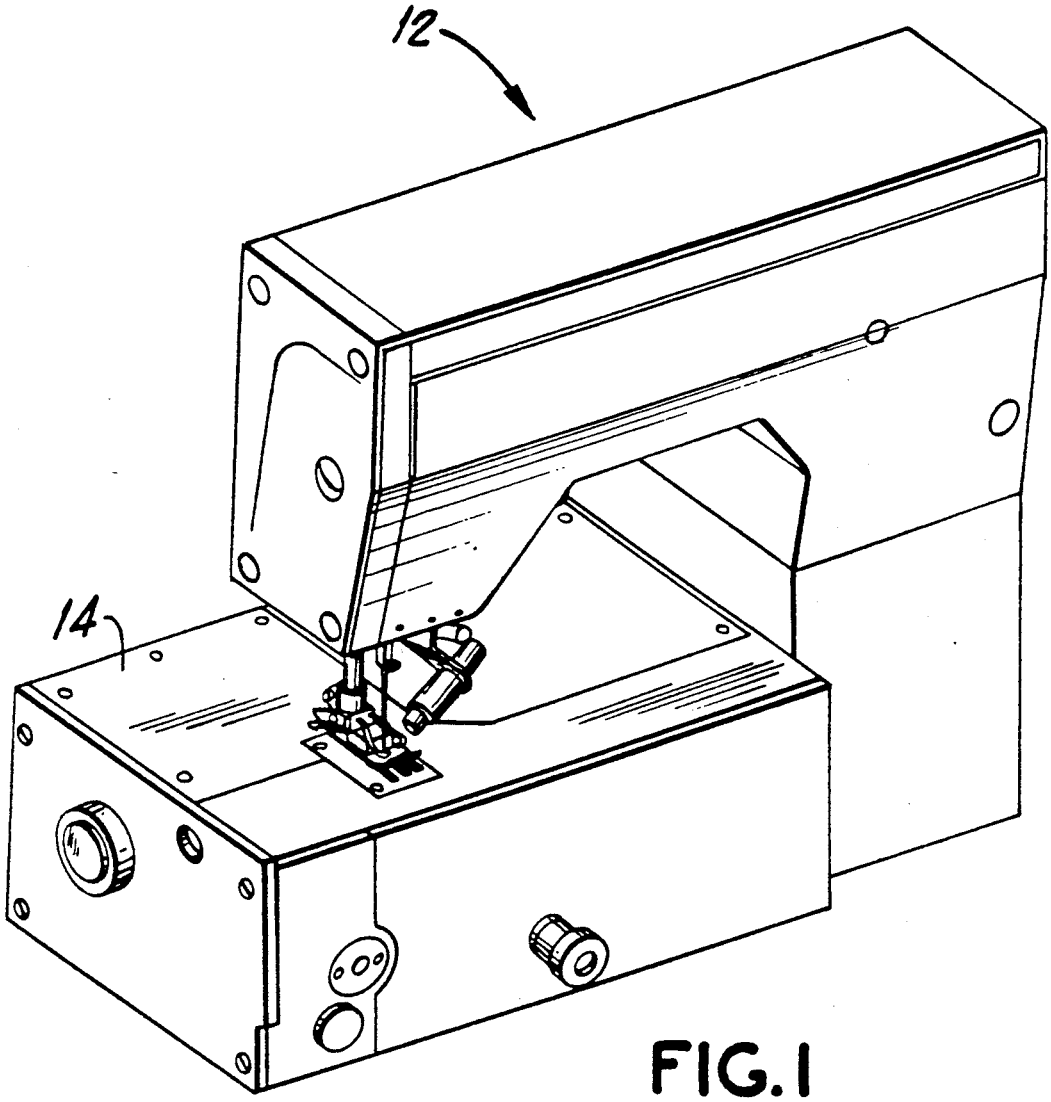
FIG. 1 is perspective view of a sewing machine for which the present invention is adapted.
Figure 2:
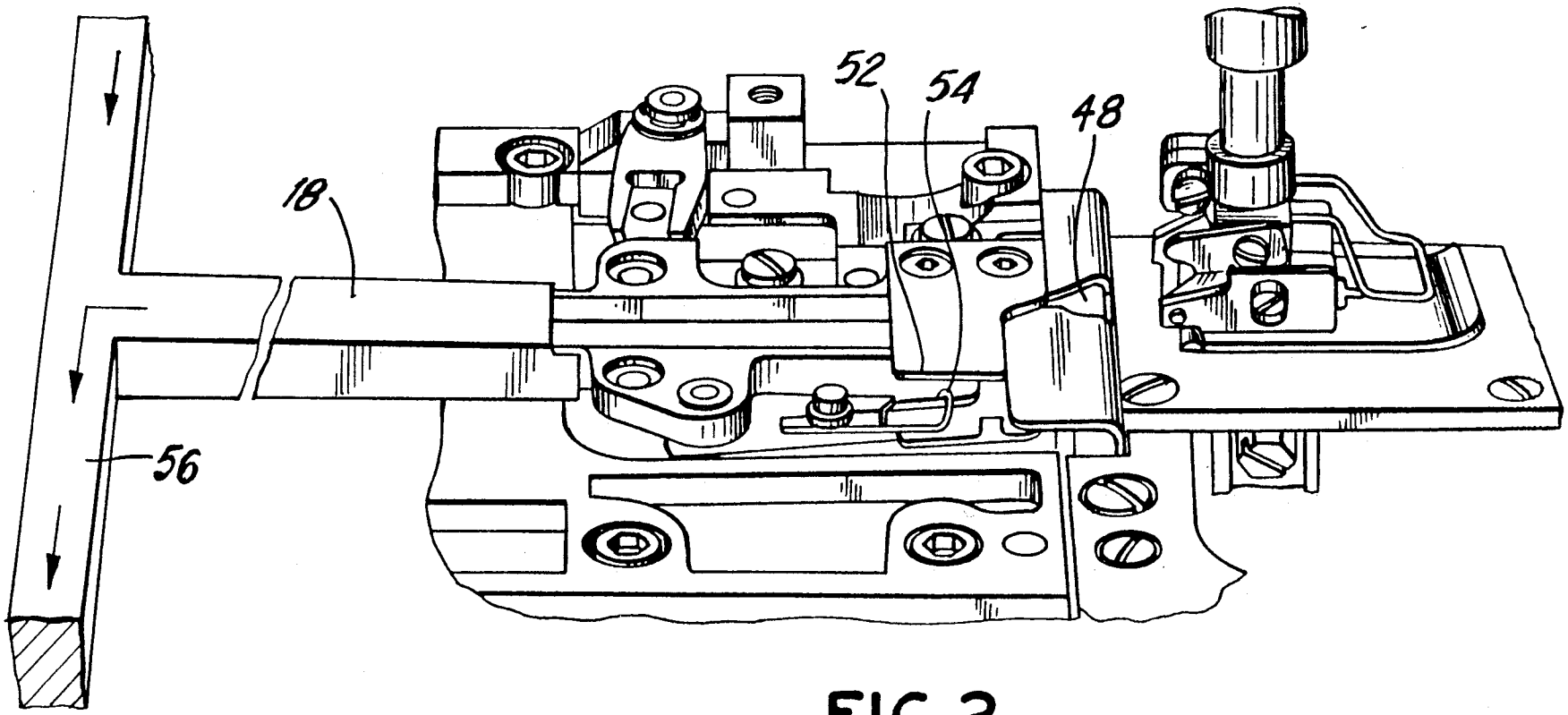
FIG. 2 is an illustration of an "AIR-KLIPP" stitch chain cutting assembly having an adjustable inlet.

The stitch chain cutting assembly, of which the adjustable inlet is a component, is mounted directly beneath the plate 14 of sewing machine 12 (FIG. 1). The stitch chain is drawn into the Cutting assembly, through the adjustable inlet 48 (FIG. 2), by means of suction or negative pressure created within a chamber 18. This suction may be created by conventional means such as the venturi tube shown in FIG. 2. An air flow is created within tube 56 by means of a motor (not shown), which air flow creates the negative pressure in chamber 18 attached thereto. Once severed by known cutting means comprised of upper blade 52 and lower blade 54, the stitch chain is carried away through the chamber 18 and tube 56 to a suitable disposal point.

The adjustable inlet of the present invention is comprised of two members which act together to define an opening through which the stitch chain enters the stitch chain cutting assembly to be cut. The opening may be widened or narrowed to accommodate stitch chains of various thicknesses.

Figure 3:
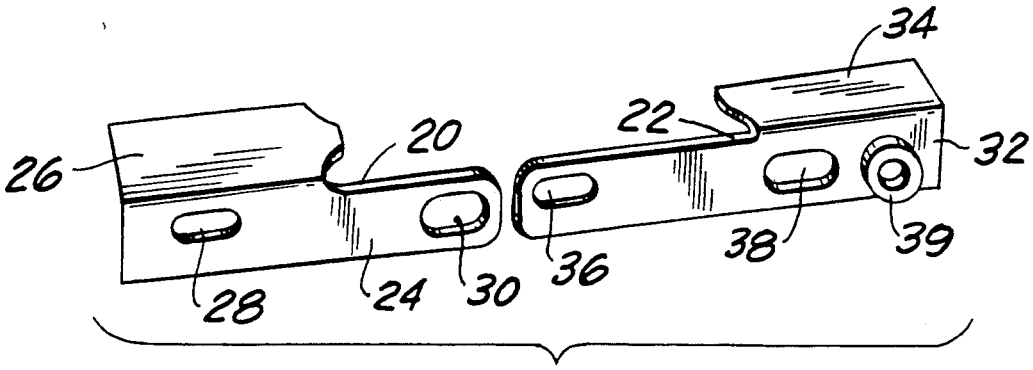
FIG. 3 is a drawing of the adjustable inlet, disassembled.

Referring to FIG. 3, there is shown a preferred embodiment of the present invention. The adjustable inlet is comprised of two members, 20 and 22. The first member 20 having a front side 24 and a top side 28 substantially perpendicular to the front side 24. The front side 24 is longer than the top side 26, and has two holes 22 and 30 disposed along its length. The second member 22 is substantially a mirror image of the first member 20, having an elongated front side 32 and a top side 34, and holes 36 and 38 along the front side 32. An edge guide (not shown) is mounted to the cutting assembly through a threaded hole 39 for the purpose of guiding the material through the sewing machine. Such edge guides are well known in the art.

Figure 4:
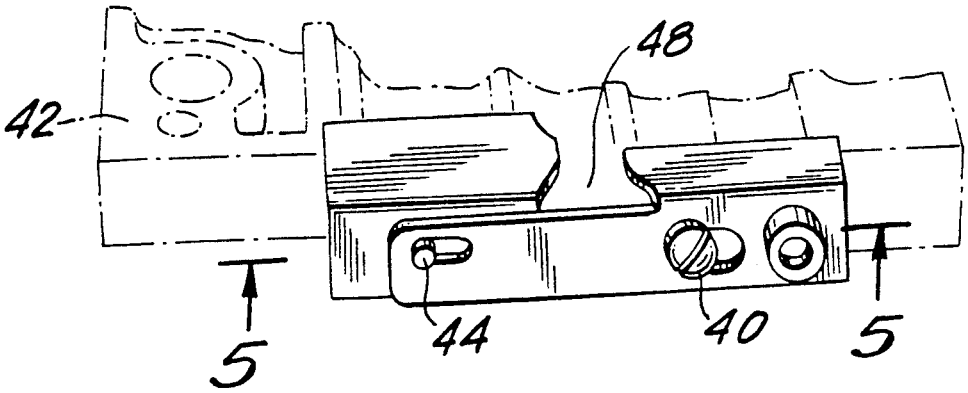
FIG. 4 is a view of the adjustable inlet as part of an "AIR-KLIPP" stitch chain cutting assembly.

Referring now to FIG. 4 there is shown one embodiment of the present invention as it is applied in an "AIR-KLIPP" stitch chain cutting assembly. The front sides 24 and 32 of the first and second members 20 and 22 overlap such that hole 28 aligns with hole 36 and hole 30 aligns with hole 38. A screw 40 fits through holes 30 and 38 and is anchored in a base 42 of the stitch chain cutting assembly to securely fix first and second members 20 and 22 in position when screw 40 is tightened. A pin 44 is located through holes 28 and 36 and anchored in the base 42 to further fix and support the first and second members 20 and 22 in position. The top sides 26 and 34 of the members 20 and 22, being shorter in length than front sides 24 and 32, have a space therebetween. This space is the inlet 48, through which the stitch chain enters the stitch chain cutting assembly to be cut.

Figure 7:
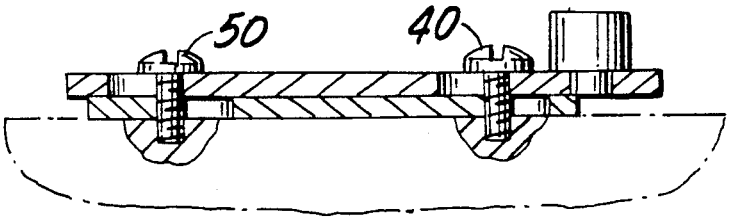
FIG. 7 is a cross sectional view of an adjustable inlet mounted to the base of the stitch chain cutting assembly by two screws.

FIG. 7 illustrates an alternative embodiment of the present invention wherein the pin 44 is replaced by a screw 50. In such an embodiment, the first and second members 20 and 22 may be mounted and securely affixed to the entrance of the stitch chain cutting assembly by means of the two screws 40 and 50 located through holes 30 and 38, and 28 and 36 respectively.

Figure 5:
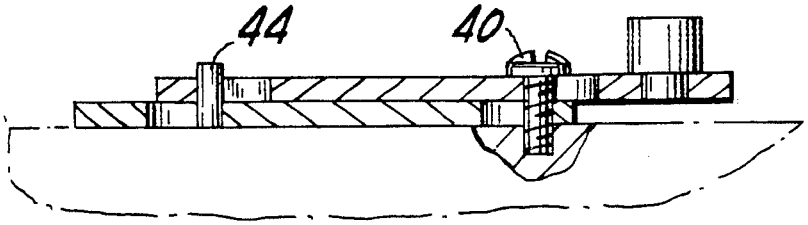
FIG. 5 is a cross sectional view from FIG. 4 showing the position of the screw and pin in the elongated holes of the adjustable inlet at its widest opening.
Figure 6:
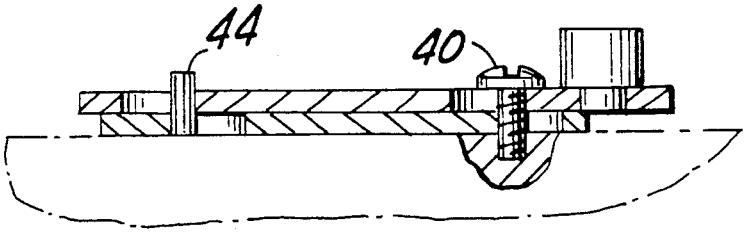
FIG. 6 is a cross sectional view from FIG. 4 showing the position of the screw and pin in the elongated holes of the adjustable inlet at its smallest opening.

The holes 28, 36, 30 and 38 are elongated so that adjustment of the position of the first and second members 20 and 22 is possible to the extent allowed by the elongated holes. As seen in FIG. 5., the inlet has a maximum aperture when the pin 44 and the screw 40 abut against the extreme right side (from the perspective of FIG. 5) of holes 28 and 30 of member 20, and the extreme left side of holes 36 and 38 of member 22. Likewise, as shown in FIG. 6, the inlet has a minimum aperture when the pin 44 and the screw 40 abut against the extreme left side (from the perspective of FIG. 6) of holes 28 and 30 of member 20, and the extreme right side of holes 36 and 38 of member 22.

When it is necessary to adjust the size of the inlet 42 to accommodate a thicker or thinner stitch chain, screw 40, or screws 40 and 50, are loosened and the member 20 and/or the member 22 are moved apart (to accommodate a thicker stitch chain) or moved closer together (to accommodate a thinner stitch chain).

While the foregoing describes one embodiment of the adjustable inlet in accordance with the present invention as associated with a stitch chain cutting assembly employing pneumatic means for driving the chain cutting blades, the invention may also be readily adapted for use with a stitch chain cutting assembly employing mechanical means for driving the chain cutting blades.

Thus, although the invention has been described in detail herein, it should be understood that the invention is not limited to the embodiments herein disclosed. Various changes, substitutions and modifications may be made thereto by those skilled in the art without departing from the spirit or scope of the invention defined by the appended claims.

What is claimed is:

1. A sewing machine, comprising:

a stitch chain cutting assembly; and means for variably adjusting an inlet to said cutting assembly accommodate stitch chains of various thicknesses.

2. An inlet adjusting mechanism for a stitch chain cutting assembly of a sewing machine, comprising:

a first member having a front side and a top side adjustably mounted at an inlet to the stitch chain cutting assembly;

a second member having a front side and a top side adjustably mounted at the inlet to the stitch chain cutting assembly and situated relative to the first member such that the front sides of the first and second members overlap each other and the top sides of the first and second members together define an opening to the stitch chain cutting assembly, which opening may be widened or narrowed to accommodate stitch chains of various thicknesses; and mounting means for mounting the inlet to the stitch chain cutting assembly.

3. An inlet adjusting mechanism for a stitch chain cutting assembly as recited in claim 2, wherein the mounting means comprises a screw means.

4. An inlet adjusting mechanism for a stitch chain cutting assembly as recited in claim 2, wherein the mounting means comprises a screw means and a pinning means.

5. An entrance adjusting mechanism for a stitch chain cutting assembly of a sewing machine comprising:

a first member having a front side and a top side adjustably mounted at the entrance to the stitch chain cutting assembly;

a second member having a front side and a top side adjustably mounted at the entrance to the stitch chain cutting assembly, wherein the first and second members attach to the stitch chain cutting assembly by mounting means comprising at least one screw through at least one horizontally elongated hole located on the front sides of the first and second members, such that the first and second members are securely fixed when the screw is in a tightened position and capable of horizontal adjustment when the screw is in a loosened position.

* * * * *